US005105719A

United States Patent [19]

Yoshikawa

[11] Patent Number: 5,105,719

[45] Date of Patent: Apr. 21, 1992

[54] STROKE CONTROL DEVICE WITH TORQUE RESPONSIVE MOTIVE FLUID CONTROL

[75] Inventor: Noritaka Yoshikawa, Higashiosaka, Japan

[73] Assignee: Yoshikawa Iron Works Ltd., Osaka, Japan

[21] Appl. No.: 626,294

[22] Filed: Dec. 12, 1990

[51] Int. Cl.[5] ..... F01C 21/12

[52] U.S. Cl. ..... 91/59; 74/388 R; 60/463

[58] Field of Search ..... 91/47, 59, 519, 449, 91/358 R, 359, 361; 60/463, 451; 74/388 R

[56] References Cited

U.S. PATENT DOCUMENTS

| | | | |
|---|---|---|---|
| Re. 28,899 | 7/1976 | Himmelstein et al. | 91/59 X |
| 2,650,669 | 9/1953 | Hammond | 60/401 X |
| 3,128,673 | 4/1964 | Moore, Jr. | 91/48 X |
| 3,920,082 | 11/1975 | Dudek | 91/59 X |
| 4,205,592 | 6/1980 | Haussler | 91/449 |
| 4,614,248 | 9/1986 | Kakinami et al. | 180/79.1 |
| 4,669,359 | 6/1987 | Shiba | 91/361 |
| 4,858,436 | 8/1989 | Brusasco | 74/388 R X |

*Primary Examiner*—Edward K. Look
*Assistant Examiner*—John Ryznic
*Attorney, Agent, or Firm*—Wenderoth, Lind & Ponack

[57] ABSTRACT

A stroke control device having a servomotor, a hydraulic cylinder having a piston, a ball-thread mechanism coupling the servomotor with the piston, and a hydraulic circuit including pressure control valves for driving the hydraulic cylinder. Further it has a numerical control unit for driving the servomotor based on the numerical input data representative of the movement and moving speed of the piston, for detecting signals representative of the load on the servomotor and for producing control signals to control the pressure control valves in the hydraulic circuit in response to the load signals to move the piston so that the load on the servomotor will approach zero.

2 Claims, 3 Drawing Sheets

STROKE CONTROL DEVICE WITH TORQUE RESPONSIVE MOTIVE FLUID CONTROL

This invention relates to a stroke control device for positioning a rivet head forming tool on a riveting machine or the like.

FIG. 3 shows a conventional riveting machine in which a rotary shaft 3 for power transmission between a motor 1 and a rivet head forming tool 2 is rotatably mounted in a piston shaft 5 of a hydraulic cylinder 4. The downstroke of the piston 5 (i.e. the stroke of the hydraulic cylinder) is adjusted by a positioning device 6.

This positioning device 6 comprises a rotary control sheath 6*a* rotatably mounted on the upper end of the hydraulic cylinder 4, an annular nut plate 6*b* in threaded engagement with internal threads of the rotary sheath 6*a* and mounted on the piston shaft 5, an engaging block 6*c* secured to the top end of the piston shaft 5 and vertically inserted in the rotary sheath 6*a*, and a pin 6*d* having one end thereof secured to the nut plate 6*b* and the other end inserted in an elongated hole formed in the engaging block 6*c*. The downstroke of the piston shaft 5 is controlled by abutment of the engaging block 6*c* with the nut plate 6*b*.

Since the nut plate 6*b* is prevented by the pin 6*d* from rotating, it is moved up and down by rotating the rotary control sheath 6*a*. Thus the downstroke can be adjusted by adjusting the position of the nut plate 6*b*.

But it was difficult with such a conventional positioning device to adjust the downstroke reliably at one operation because the rotary sheath 6*a* has to be turned manually. Thus setup took a lot of time and precise positioning was difficult.

An object of this invention is to provide a stroke control device which allows easy and precise positioning by inputting numerical data.

In accordance with the present invention, there is provided a stroke control device comprising a servomotor, a hydraulic cylinder having a piston, a ball-thread mechanism coupling the servomotor with the piston, a hydraulic circuit including pressure control valves for driving the hydraulic cylinder, and a numerical control unit for controlling the servomotor based on the numerical input data representative of the movement and moving speed of the piston, for detecting signals representative of the load on the servomotor and for producing control signals to control the pressure control valves in the hydraulic circuit in response to the load signals to move the piston so that the load on the servomotor will become zero.

According to the numerical information on the movement and the moving speed which has been inputted in the numerical control unit, the servomotor rotates and pushes the piston of the hydraulic cylinder through the ball-thread mechanism. In this state, a torque is generated by the servomotor. The numerical control unit will control to drive the piston of the hydraulic cylinder by an amount corresponding to the rotation of the servomotor while controlling the fluid pressure in the hydraulic cylinder by means of the pressure control valve so as to keep the torque around zero. The moment the servomotor stops, the hydraulic circuit will be closed by the reset signal from the numerical control unit. Thus the oil in the hydraulic cylinder is discharged and the piston is returned to its initial position by reversing the servomotor.

Since the piston of the hydraulic cylinder moves following the rotation of the servomotor without affecting the turning torque of the servomotor, the movement and the moving speed inputted can be attained with high accuracy.

With the stroke control device according to this invention, by driving the servomotor having a high output accuracy with the numerical control unit receiving numerical data and by changing the set pressure of the pressure control valve in the hydraulic circuit, the turning torque of the servomotor is feedback controlled so that the hydraulic cylinder capable of generating a large output will follow the servomotor. Thus, the stroke control can be done with high accuracy.

Also, by using this device with a driving means for a rivetting machine, setup can be changed easily by changing the numerical input data.

Other features and objects of the present invention will become apparent from the following description taken with reference to the accompanying drawings, in which.

Figure 1:
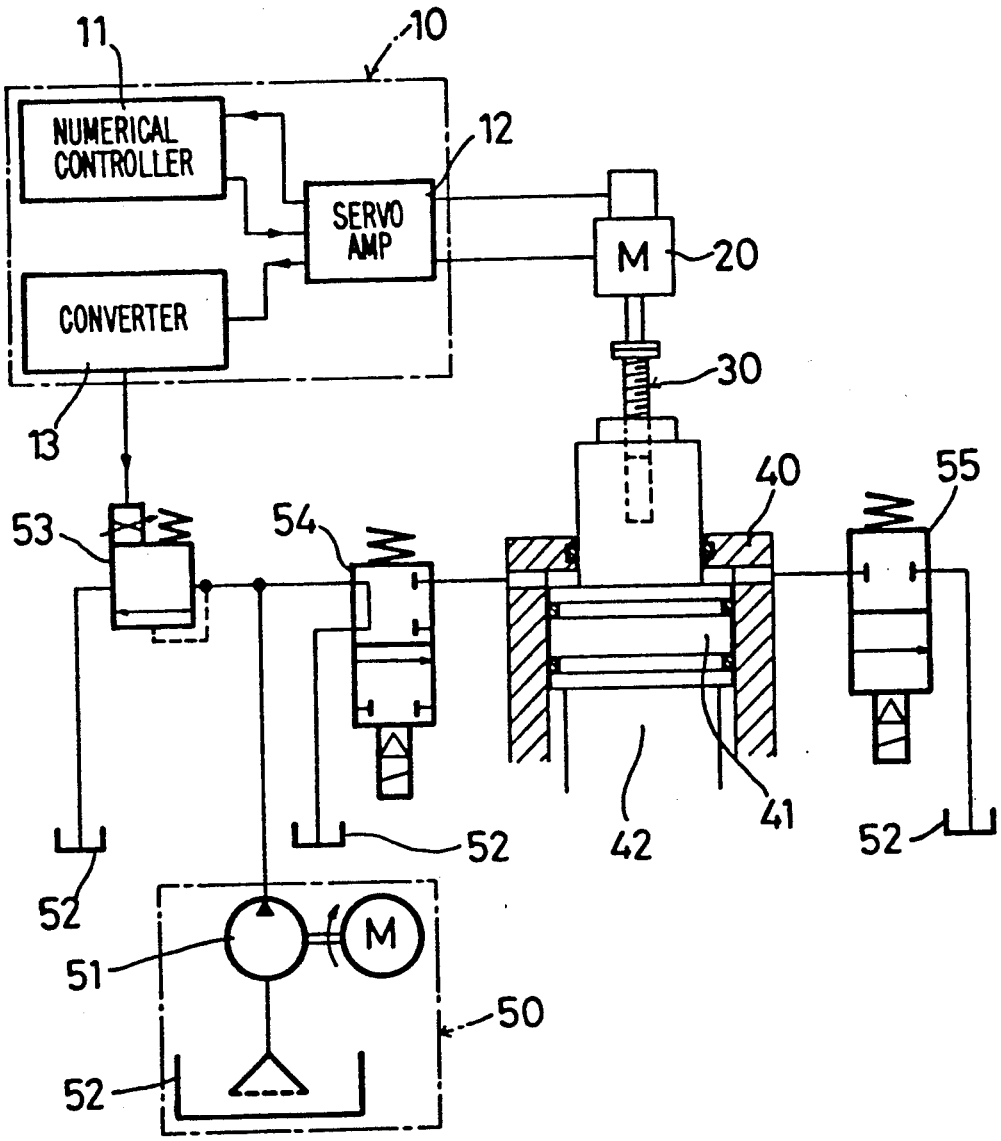
FIG. 1 is a diagrammatic view showing the relation between the numerical control unit and the hydraulic circuit in one embodiment of this invention.

FIG. 1 is a diagrammatic view showing the stroke control device according to this invention. As shown in this figure, a numerical control unit 10 comprises a numerical controller 11, a servo amplifier 12 and a converter 13. The movement and moving speed inputted in the numerical control unit 10 as numerical data are applied from the numerical controller 11 to a servomotor 20 through the servo amplifier 12. The servomotor 20 is fixed in a predetermined position and coupled to a piston 41 having a pressure application rod 42 of a hydraulic cylinder 40 through a ball-thread mechanism 30.

In a hydraulic circuit as a driving source of the hydraulic cylinder 40, the oil pressure in the hydraulic cylinder 40 is adjusted by releasing the delivery pressure of a hydraulic pump 51 to a tank 52 through a solenoid relief valve 53. The pressure set at the relief valve 53 is controlled by the numerical control unit, which receives electric torque signals from the servomotor 20 and generates control signals based on these electric signals to keep the torque at zero.

Figure 2:
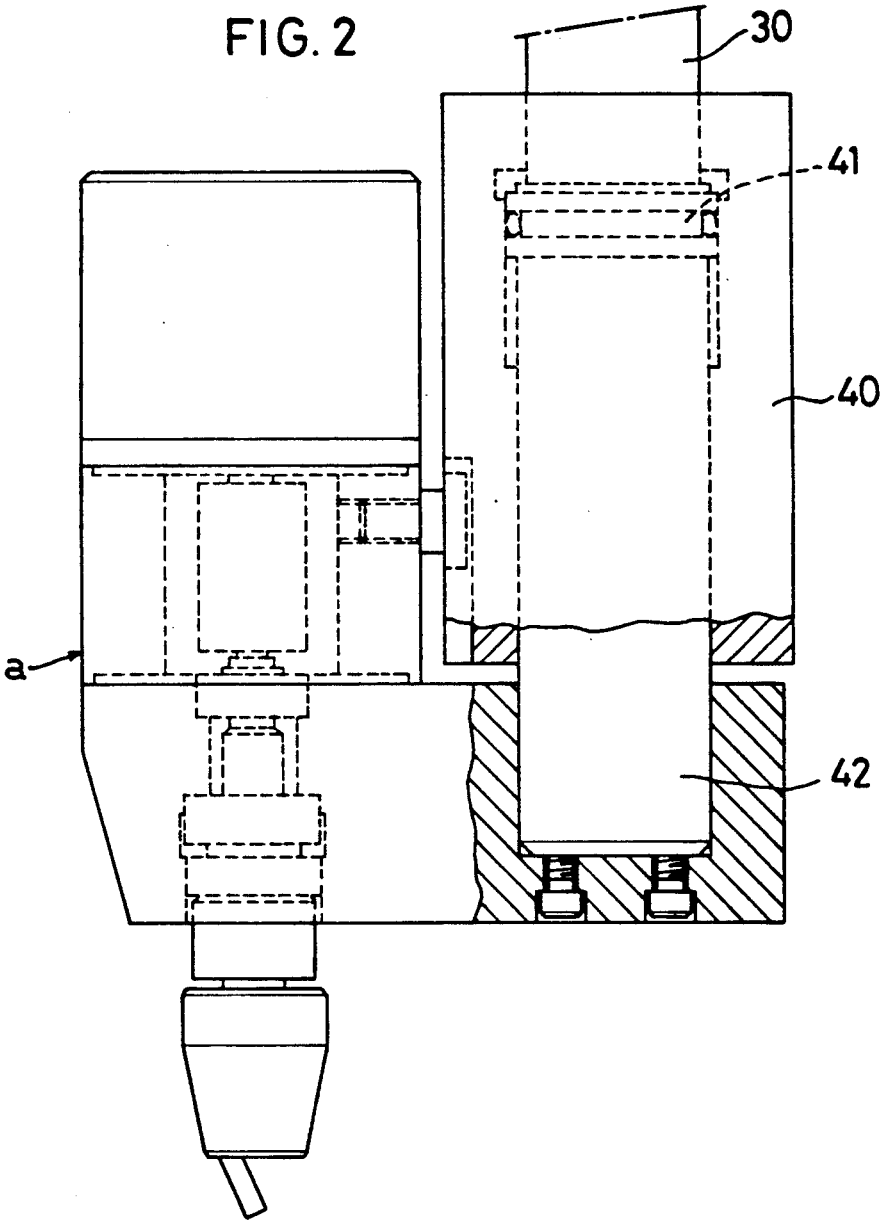
FIG. 2 is a side view of a portion of the same showing how it is mounted on a rivetting machine.
Figure 3:
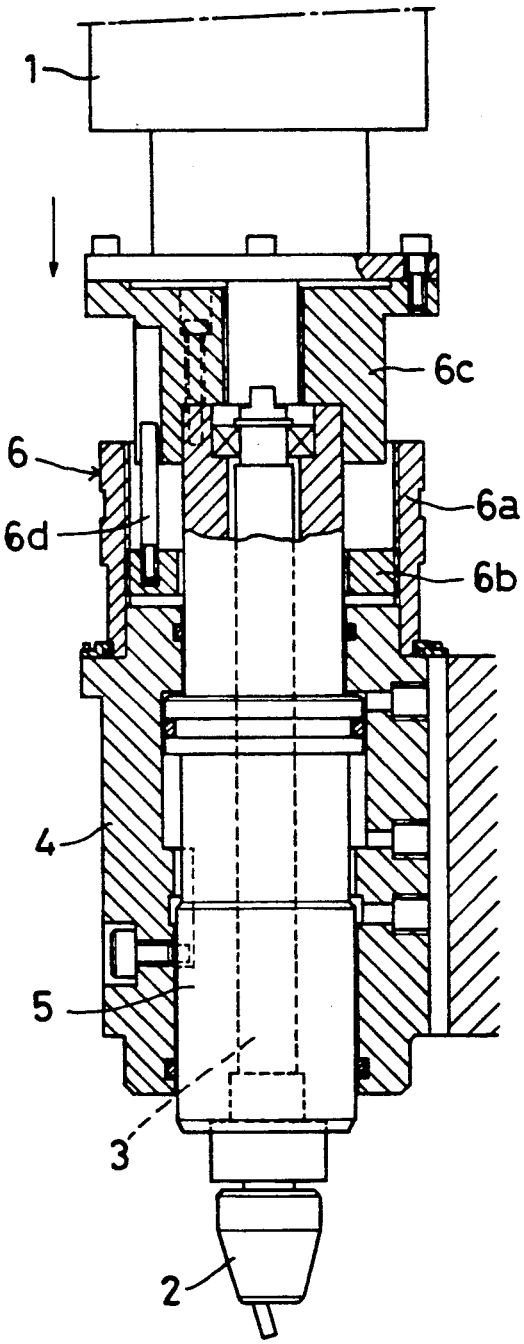
FIG. 3 is a sectional view showing a prior art device.

This stroke control device is used e.g. as a driving mechanism by coupling the pressure application rod 42 to a rotary head a of a riveting machine as shown in FIG. 2.

In such a case, the movement and moving speed of the rotary head a are inputted in the numerical control unit 10 as numerical information. When the device is started, the numerical information will be supplied from the numerical controller 11 as electric signals to the servomotor 20 through the servo amplifier 12. The servomotor 20 will begin to rotate in response to the signals. In this state, a hydraulic pump unit 50 has been activated and oil is being returned in the tank 52 by the solenoid valve 54. But the moment the servomotor 20 begins to rotate, the solenoid valve 54 will open, so that oil pressure will be supplied into the hydraulic cylinder 40.

When the torque of the servomotor, which is transmitted through the ball-thread mechanism 30, acts on the piston 41 to push it down, a load or torque will be produced. In response to the torque signals from the servomotor 20, the numerical control unit 10 generates control signals to the solenoid relief valve 53 to keep the torque at zero.

In response to the control signals, the solenoid relief valve 53 will increase the pressure in the hydraulic cylinder 40 while changing the set pressure. Thus, the piston 41 will be pushed down until the torque becomes zero. In this state, the servomotor 20 will urge to push the piston 41 down, so that a torque will be generated. This operation is repeated continuously.

Since the torque can be kept normally at zero by such feedback control, the piston 41, as well as its driving force and the pressure necessary for rivetting, can be controlled so that they will follow the movement of the high-precision servomotor 20. Thus, when the servomotor 20 stops, riveting will be complete in an optimum way.

After stopping the servomotor 20, in response to a reset command from the numerical control unit 10, the solenoid valve 54 will be closed, thus closing the oil feed circuit while the solenoid valve 55 will be opened, thus discharging the oil in the hydraulic cylinder 40 into the tank 52. Further, the servomotor 20 is turned in a reverse direction to raise the piston. When the oil in the hydraulic cylinder 40 is returned to the tank 52 and the piston 41 is raised to its initial position, the solenoid valve 55 is closed to close up the hydraulic cylinder 40.

What is claimed is:

1. A stroke control device comprising: a servomotor, a hydraulic cylinder having a piston, a ball screw coupling said servomotor with said piston, a hydraulic circuit operatively hydraulically associated with said hydraulic cylinder so as to introduce hydraulic fluid thereto which will act to drive said piston, said hydraulic circuit including pressure control valves operable to regulate the pressure of hydraulic fluid introduced to said hydraulic cylinder, and numerical control unit means operatively connected to said servomotor for controlling said servomotor based on numerical input data representative of desired movement and moving speed of said piston, for detecting load on said servomotor, and for producing control signals to control said pressure control valves in said hydraulic circuit in response to the load to regulate the pressure of the hydraulic fluid introduced to the hydraulic cylinder to a pressure at which the piston will be driven without loading said servomotor.

2. A stoke control device as claimed in claim 1, wherein said pressure control valves includes a variable solenoid-operated pressure relief valve operatively hydraulically connected in-line with said hydraulic cylinder, and said numerical control unit means is operatively connected to said pressure relief valve for setting the pressure at which the pressure relief valve will open.

* * * * *